US005826349A

United States Patent [19]

Goss

[11] Patent Number: 5,826,349

[45] Date of Patent: Oct. 27, 1998

[54] VENILATED SHOE SYSTEM

[76] Inventor: Chauncey D. Goss, 5930 County Rd. J, Mondovi, Wis. 54755

[21] Appl. No.: 828,057

[22] Filed: Mar. 28, 1997

[51] Int. Cl.[6] ..... A43B 7/06

[52] U.S. Cl. ..... 36/3 R; 36/3 B; 36/29; 36/35 B

[58] Field of Search ..... 36/3 R, 3 B, 28, 36/29, 35 B

[56] References Cited

U.S. PATENT DOCUMENTS

| | | | |
|---|---|---|---|
| 417,858 | 12/1889 | Church | 36/3 B |
| 426,495 | 4/1890 | Falkner | 36/3 B |
| 545,705 | 9/1895 | Macdonald | 36/29 |
| 1,453,394 | 5/1923 | Klepac | 36/3 B |
| 3,331,146 | 7/1967 | Karras | 36/3 B |
| 3,871,117 | 3/1975 | Richmond et al. | 36/29 |
| 4,860,463 | 8/1989 | Pin | 36/3 B |
| 5,375,345 | 12/1994 | Djuric | 36/3 B |
| 5,400,526 | 3/1995 | Sessa | 36/3 B |

FOREIGN PATENT DOCUMENTS

| | | | |
|---|---|---|---|
| 3610354 | 10/1987 | Germany | 36/3 B |
| 2165439 | 4/1986 | United Kingdom | 36/3 B |
| 2189679 | 11/1987 | United Kingdom | 36/3 B |

*Primary Examiner*—M. D. Patterson

[57] ABSTRACT

A ventilated shoe system for providing fresh air to the user's feet to aid in the control of perspiration and odors includes a plurality of resilient encasements positioned within the sole of a shoe, a plurality of check valves connected between the resilient encasements, an air intake connected to the resilient encasements, and a plurality of apertures projecting into the sole of the shoe.

5 Claims, 4 Drawing Sheets

FIG. 3
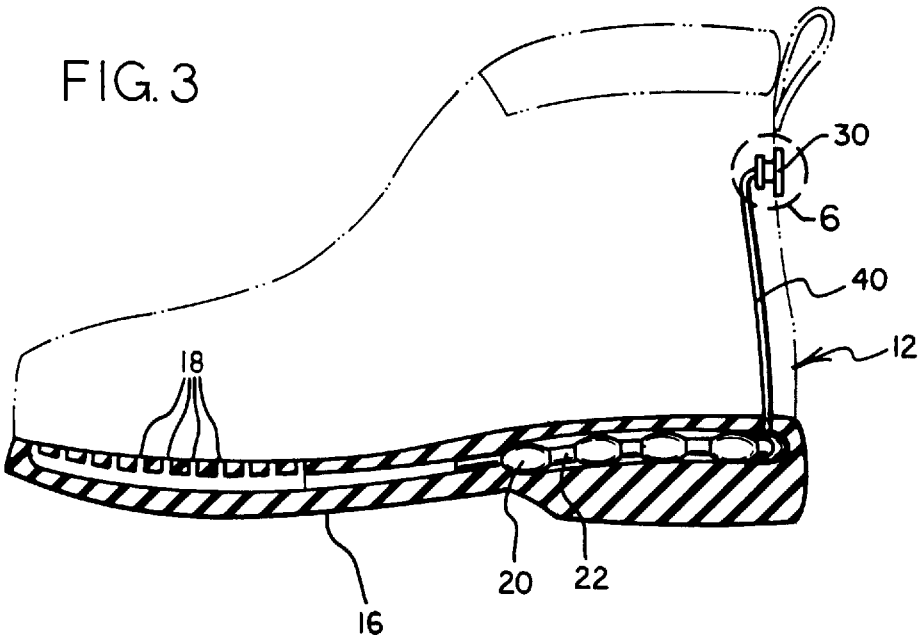
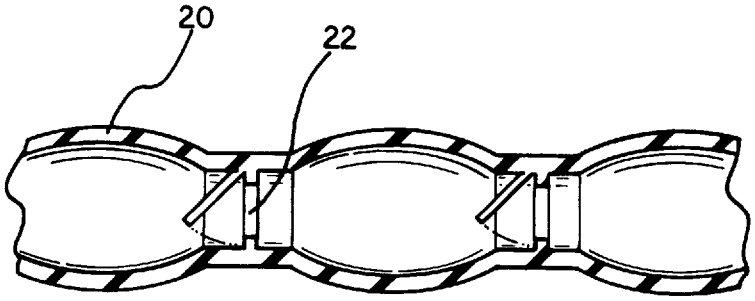
FIG. 4

FIG. 5
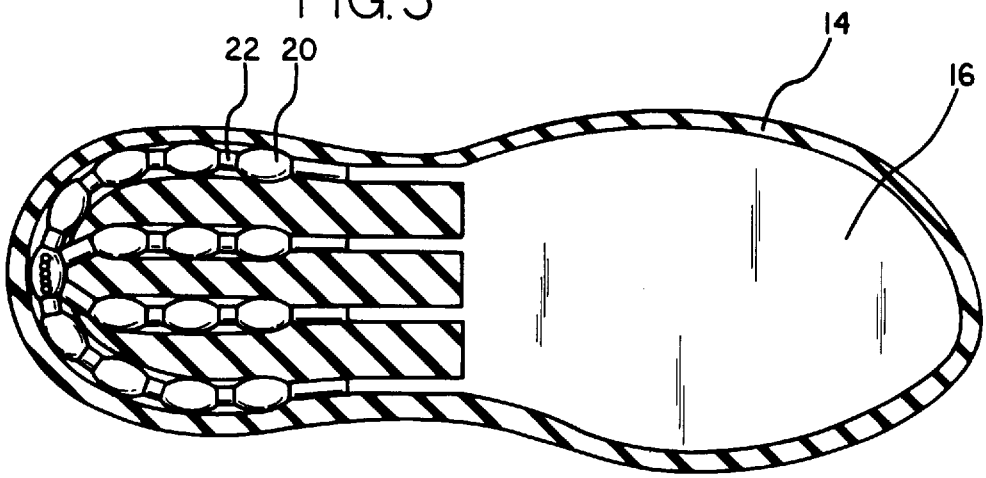
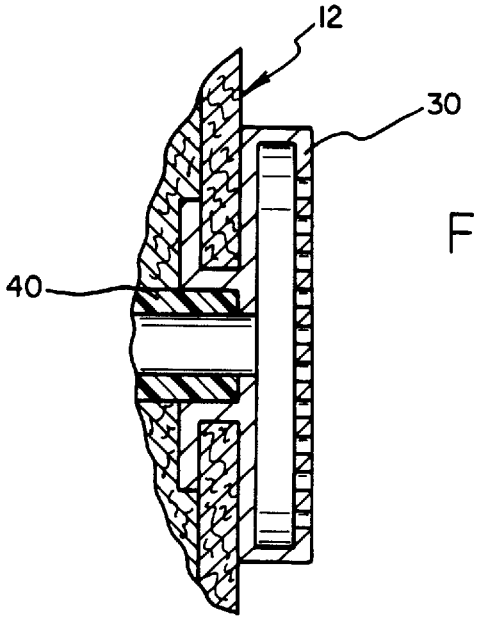
FIG. 6

FIG. 7
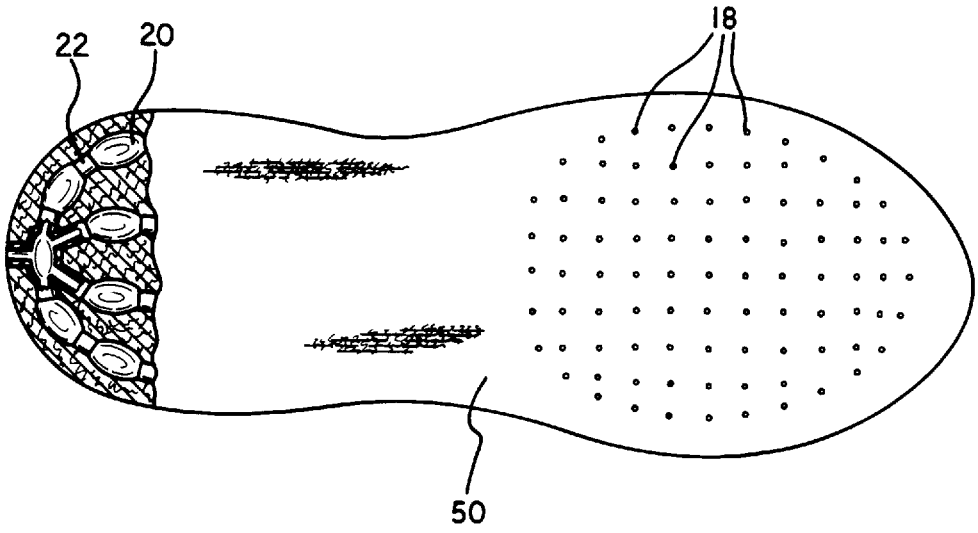
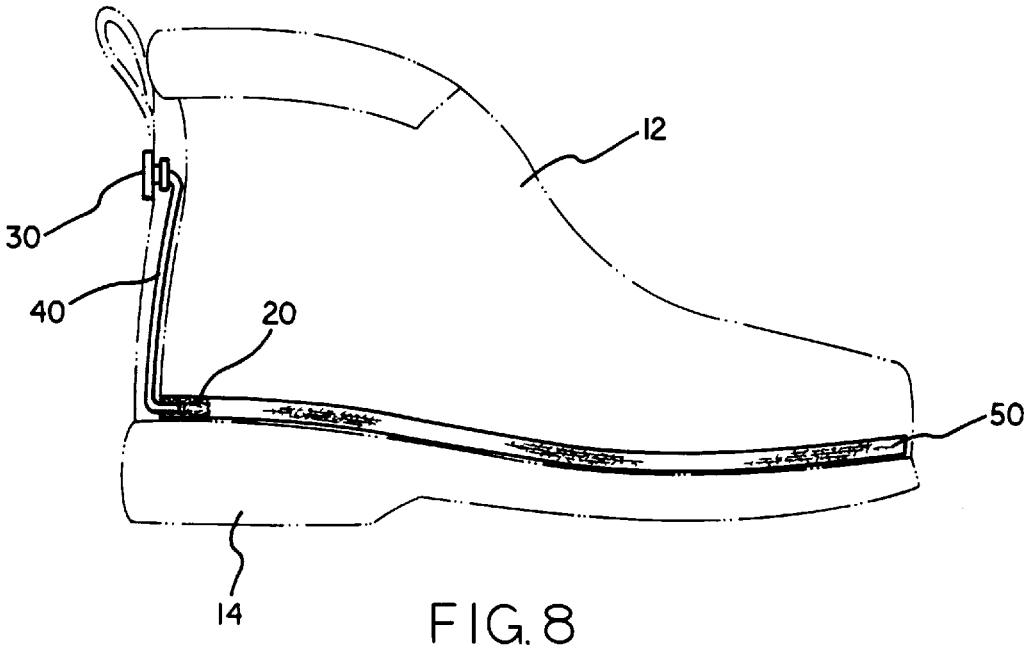
FIG. 8

VENILATED SHOE SYSTEM

BACKGROUND OF THE INVENTION

1. Field of the Invention

The present invention relates to Ventilation Devices and more particularly pertains to a new Ventilated Shoe System for providing fresh air to the user's feet within shoes to aid in the control of perspiration and odor.

2. Description of the Prior Art

The use of Ventilation Devices is known in the prior art. More specifically, Ventilation Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Ventilation Devices include U.S. Pat. No. 5,138,775; U.S. Pat. No. 5,408,760; U.S. Pat. No. 5,010,661; U.S. Pat. No. 4,760,651; U.S. Pat. No. 4,776,110 and U.S. Design Pat. No. 350,013.

While these devices fulfill their respective, particular objectives and requirements, the aforementioned patents do not disclose a new Ventilated Shoe System. The inventive device includes a plurality of resilient encasements positioned within the sole of a shoe, a plurality of check valves connected mesially the resilient encasements, an air intake connected to the resilient encasements, and a plurality of apertures projecting into the sole of the shoe.

In these respects, the Ventilated Shoe System according to the present invention substantially departs from the conventional concepts and designs of the prior art, and in so doing provides an apparatus primarily developed for the purpose of providing fresh air to the user's feet within shoes to aid in the control of perspiration and odor.

SUMMARY OF THE INVENTION

In view of the foregoing disadvantages inherent in the known types of Ventilation Devices now present in the prior art, the present invention provides a new Ventilated Shoe System construction wherein the same can be utilized for providing fresh air to the user's feet within shoes to aid in the control of perspiration and odor.

The general purpose of the present invention, which will be described subsequently in greater detail, is to provide a new Ventilated Shoe System apparatus and method which has many of the advantages of the Ventilation Devices mentioned heretofore and many novel features that result in a new Ventilated Shoe System which is not anticipated, rendered obvious, suggested, or even implied by any of the prior art Ventilation Devices, either alone or in any combination thereof.

To attain this, the present invention generally comprises a plurality of resilient encasements positioned within the sole of a shoe, a plurality of check valves connected mesially the resilient encasements, an air intake connected to the resilient encasements, and a plurality of apertures projecting into the sole of the shoe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Ventilated Shoe System apparatus and method which has many of the advantages of the Ventilation Devices mentioned heretofore and many novel features that result in a new Ventilated Shoe System which is not anticipated, rendered obvious, suggested, or even implied by any of the prior art Ventilation Devices, either alone or in any combination thereof.

It is another object of the present invention to provide a new Ventilated Shoe System which may be easily and efficiently manufactured and marketed.

It is a further object of the present invention to provide a new Ventilated Shoe System which is of a durable and reliable construction.

An even further object of the present invention is to provide a new Ventilated Shoe System which is susceptible of a low cost of manufacture with regard to both materials and labor, and which accordingly is then susceptible of low prices of sale to the consuming public, thereby making such Ventilated Shoe System economically available to the buying public.

Still yet another object of the present invention is to provide a new Ventilated Shoe System which provides in the apparatuses and methods of the prior art some of the advantages thereof, while simultaneously overcoming some of the disadvantages normally associated therewith.

Still another object of the present invention is to provide a new Ventilated Shoe System for providing fresh air to the user's feet within shoes to aid in the control of perspiration and odor.

Yet another object of the present invention is to provide a new Ventilated Shoe System which includes a plurality of resilient encasements positioned within the sole of a shoe, a plurality of check valves connected mesially the resilient encasements, an air intake connected to the resilient encasements, and a plurality of apertures projecting into the sole of the shoe.

Still yet another object of the present invention is to provide a new Ventilated Shoe System that provides fresh air to the interior portion of a shoe without a power source.

Even still another object of the present invention is to provide a new Ventilated Shoe System that keeps feet dry during operation of the shoes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein:

FIG. 3 is a cross sectional view taken along line 3—3 of FIG. 2.

FIG. 4 is a magnified cut-away view from FIG. 3.

FIG. 5 is a cross sectional view taken along line 5—5 of FIG. 2.

FIG. 6 is a magnified cut-away view of the air intake.

FIG. 7 is a cut-away top view of an alternative embodiment comprising a sole insert.

FIG. 8 is a cut-away side view of the alternative embodiment.

DESCRIPTION OF THE PREFERRED EMBODIMENT

Figure 1:
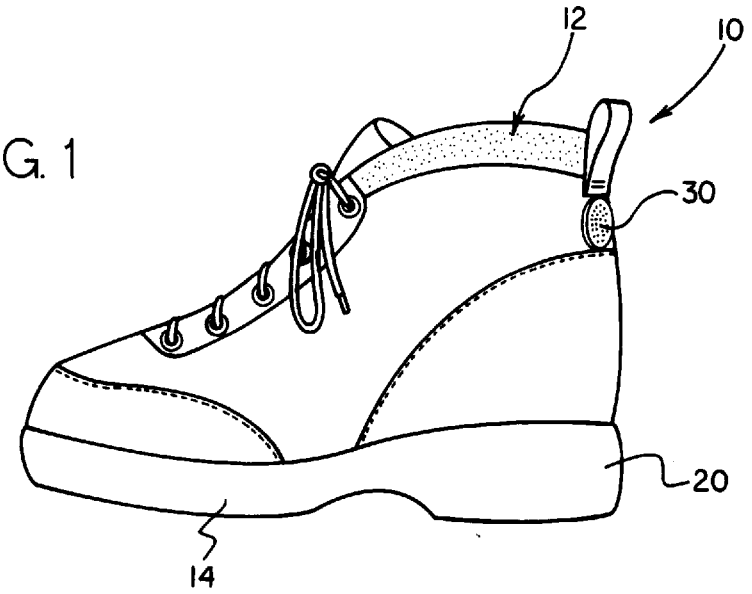
FIG. 1 is a side view of a new Ventilated Shoe System according to the present invention within a shoe.

With reference now to the drawings, and in particular to FIGS. 1 through 8 thereof, a new Ventilated Shoe System embodying the principles and concepts of the present invention and generally designated by the reference numeral 10 will be described.

More specifically, it will be noted that the Ventilated Shoe System 10 comprises a plurality of resilient encasements 20 positioned within the sole 14 of a shoe 12, an intake tube 40 connected to the plurality of resilient encasements 20, a plurality of apertures project into the sole 14 of the shoe 12, and an air intake 30 connected to the intake tube 40 opposite of the resilient encasements 20. The intake tube 40 is preferably swaged for providing maximum comfort to a user.

Figure 2:
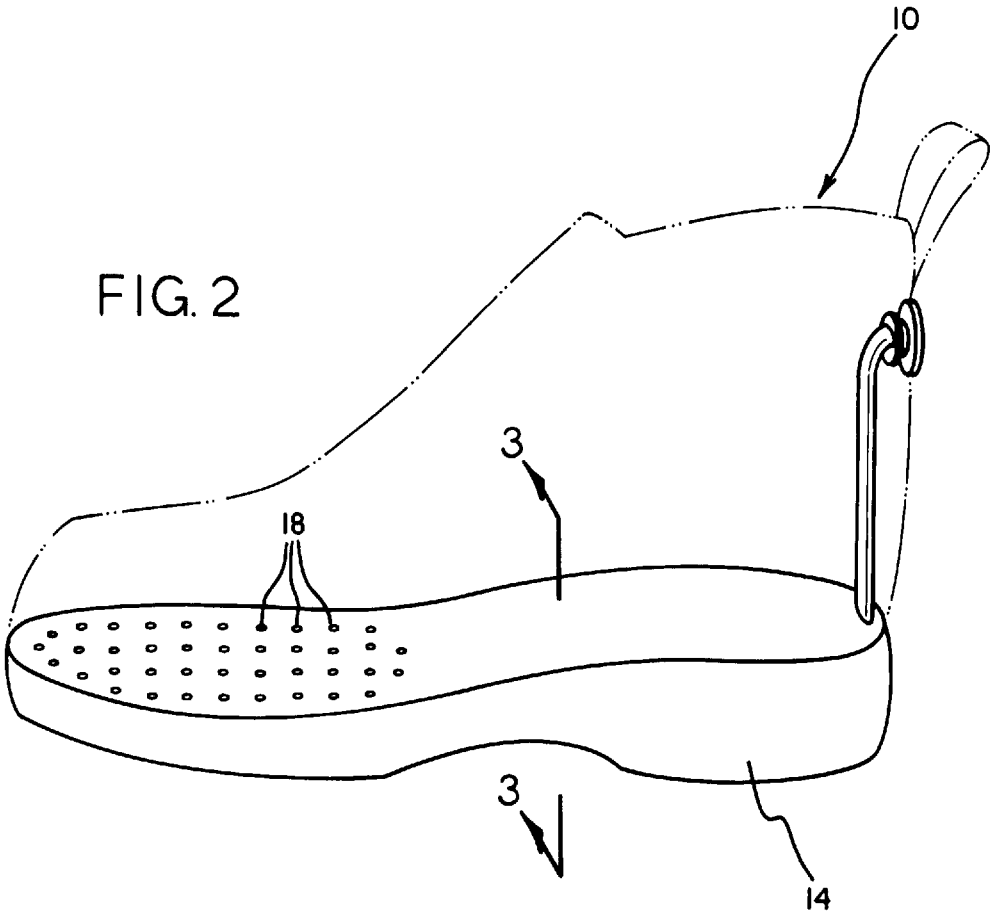
FIG. 2 is an upper perspective view of the present invention.

As shown in FIGS. 1 and 3, the resilient encasements 20 are positioned within a swaged cavity 16 within a sole 14 of a shoe 12 near the rear portion thereof. As shown in FIGS. 3 through 5 of the drawings, a plurality of check valves 22 are connected mesially the resilient encasements 20 thereby interconnecting the resilient encasements 20. An intake tube 40 is connected to the resilient encasements 20 as shown in FIGS. 3 through 5 of the drawings. The intake tube 40 provides fresh air to the resilient encasements 20. An air intake 30 is connected to the intake tube 40 opposite of the resilient encasement 20 and mounted to the upper rear portion of the shoe 12 as shown in FIGS. 1 through 3 of the drawings.

In an alternative embodiment as shown in FIGS. 7 and 8 of the drawings, a sole insert 50 is formed to fit within an interior portion of the shoe 12. The resilient encasements 20 are positioned within a swaged cavity 16 within the sole insert 50 near the rear portion thereof.

In use, when the user walks, the stepping action forces the resilient encasements 20 to compress upward. The compression forces air out the check valve 22. The resilient encasements 20 expand after pressure is relieved thereby closing the check valve 22 to prevent air from within the shoe 12 to flow back into resilient encasement. The air intake 30 receives fresh air from the upper rear portion of the shoe 12 which flows through the intake tube 40 into the resilient encasement 20 to replace the displaced air during compression. The above process is repeated during walking thereby keeping the interior portion of the shoe 12 dry and odorless.

As to a further discussion of the manner of usage and operation of the present invention, the same should be apparent from the above description. Accordingly, no further discussion relating to the manner of usage and operation will be provided. A plurality of apertures 18 project into sole insert 50 for allowing the air to escape into the shoe.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ventilated shoe system comprising:

an air pumping means positioned within a sole of a shoe, wherein said air pumping means is operated from the stepping motions of a user;

an intake tube connected to said air pumping means, said intake tube being for transporting fresh air to said air pumping means;

an air intake connected to said intake tube opposite of said air pumping means; and wherein said air pumping means includes a plurality of resilient encasements arranged into rows extending from a central resilient encasement, a plurality of check valves, each check valve connected between adjacent aligned resilient encasements within each row of resilient encasements thereby interconnecting said resilient encasements within each row, said plurality of check valves being for allowing unidirectional air flow into said air intake, through said air intake tube and into said central resilient encasement, out of said central resilient encasement through said rows of resilient encasements and into a cavity in said sole of said shoe, and a plurality of apertures projecting into said sole of said shoe into said cavity for allowing air pumped from said resilient encasements into said cavity to escape into said shoe.

2. The ventilated shoe system of claim 1 wherein said plurality of resilient encasements is positioned near a rear portion of said sole.

3. The ventilated shoe system of claim 1 further comprising said air intake being mounted to an upper rear portion of said shoe proximate an upper rim of said shoe.

4. A ventilated shoe system comprising:

an air pumping means positioned within a sole of a shoe, wherein said air pumping means is operated from the stepping motions of a user;

an intake tube connected to said air pumping means, said intake tube being for transporting fresh air to said air pumping means;

an air intake connected to said intake tube opposite of said air pumping means, said air intake being mounted to an upper rear portion of said shoe proximate an upper rim of said shoe; and wherein said air pumping means includes a plurality of resilient encasements arranged into rows extending from a central resilient encasement, wherein said plurality of resilient encasements is positioned near a rear portion of said sole, a plurality of check valves, each check valve connected between adjacent aligned resilient encasements within each row of resilient encasements thereby interconnecting said resilient encasements within each row, said plurality of check valves being for allowing unidirectional air flow into said air intake, through said air intake tube and into said central resilient encasement, out of said central resilient encasement through said rows of resilient encasements and into a cavity in said sole of said shoe, and a plurality of apertures projecting into said sole of said shoe into said cavity for allowing air pumped from said resilient encasements into said cavity to escape into said shoe.

5. A ventilated shoe system comprising:

an air pumping means positioned within an insole of a shoe, wherein said air pumping means is operated from the stepping motions of a user;

an intake tube connected to said air pumping means, said intake tube being for transporting fresh air to said air pumping means;

an air intake connected to said intake tube opposite of said air pumping means, said air intake being mounted to an upper rear portion of said shoe proximate an upper rim of said shoe; and wherein said air pumping means includes a plurality of resilient encasements arranged into rows extending from a central resilient encasement, said plurality of resilient encasements being positioned near a rear portion of said insole, a plurality of check valves, each check valve connected between adjacent aligned resilient encasements within each row of resilient encasements thereby interconnecting said resilient encasements within each row, said plurality of check valves being for allowing unidirectional air flow into said air intake, through said air intake tube and into said central resilient encasement, out of said central resilient encasement through said rows of resilient encasements and into a cavity in said insole, and a plurality of apertures projecting into said insole into said cavity for allowing air pumped from said resilient encasements into said cavity to escape into said shoe.

* * * * *